US011091930B2

(12) United States Patent
Grenier

(10) Patent No.: US 11,091,930 B2
(45) Date of Patent: Aug. 17, 2021

(54) PORTABLE TENT PLATFORM

(71) Applicant: Jessie Grenier, Pabos-Mills (CA)

(72) Inventor: Jessie Grenier, Pabos-Mills (CA)

( * ) Notice: Subject to any disclaimer, the term of this patent is extended or adjusted under 35 U.S.C. 154(b) by 143 days.

(21) Appl. No.: 16/577,557

(22) Filed: Sep. 20, 2019

(65) Prior Publication Data

US 2020/0109577 A1 Apr. 9, 2020

(51) Int. Cl.
*E04H 15/56* (2006.01)

(52) U.S. Cl.
CPC ..... *E04H 15/56* (2013.01)

(58) Field of Classification Search
CPC ..... E04H 15/56; E04H 15/58; A47C 17/78; B67C 11/00
See application file for complete search history.

(56) References Cited

U.S. PATENT DOCUMENTS 579,373 A * 3/1897 Wolbrecht ..... E04H 15/322 135/120.4
781,221 A 1/1905 Morris
1,427,476 A * 8/1922 Johnson ..... A47C 17/66 5/112
2,156,021 A 4/1939 Little
2,777,454 A * 1/1957 Kramer ..... E04H 15/003 135/87
2,964,222 A 12/1960 Rainwater
3,060,949 A * 10/1962 Moss ..... E04H 15/18 135/87
3,143,122 A * 8/1964 Goodrich ..... E04H 4/10 135/87
3,431,924 A 3/1969 Simpson
3,593,997 A * 7/1971 Boehner ..... A63B 71/022 473/421
3,814,118 A 6/1974 Larson
3,886,609 A 6/1975 MacKenzie
3,896,830 A * 7/1975 Sharick ..... E04H 15/10 135/93
4,063,567 A 12/1977 Martin
4,234,005 A 11/1980 Taylor, III
4,750,508 A * 6/1988 Tatoian ..... E04H 15/003 135/118
4,883,206 A 11/1989 Miller
4,885,812 A 12/1989 Carriere
5,199,214 A 4/1993 Caldwell
5,243,795 A 9/1993 Roberts
D363,755 S 10/1995 Diederich
5,477,876 A * 12/1995 Moss ..... E04H 15/26 135/100
5,489,052 A 2/1996 Blood, Jr.
5,622,197 A * 4/1997 Valaire ..... E04H 15/003 135/90
5,625,983 A 5/1997 Lachance
5,662,134 A 9/1997 Auer
(Continued)

FOREIGN PATENT DOCUMENTS

CA 2790339 7/2013
GB 107670 A * 7/1917 ..... A47C 17/78
WO 2008041864 4/2008

*Primary Examiner* — Noah Chandler Hawk

(57) ABSTRACT

A tent support platform including a flexible support sheet supported by legs mounted thereto. Anchors anchor each leg into the ground. The legs are movable independently from each other when the anchors are removed from the ground.

30 Claims, 2 Drawing Sheets

(56) References Cited

U.S. PATENT DOCUMENTS

| | | | | |
|---|---|---|---|---|
| 5,692,534 | A * | 12/1997 | Brumfield | E04H 15/322 135/115 |
| 5,988,194 | A | 11/1999 | Collins | |
| 6,062,446 | A | 5/2000 | Daneau | |
| 6,148,834 | A | 11/2000 | Grooms, Sr. | |
| 6,202,907 | B1 | 3/2001 | Higgins | |
| D529,982 | S | 10/2006 | Riley | |
| 7,207,077 | B2 | 4/2007 | Hicks | |
| 7,353,833 | B1 * | 4/2008 | Palmer | E04H 15/60 135/118 |
| 7,841,356 | B2 | 11/2010 | Shires | |
| 8,464,738 | B2 | 6/2013 | Simonson et al. | |
| 8,479,757 | B2 | 7/2013 | Zhou | |
| 8,684,020 | B1 * | 4/2014 | Shires | E04H 15/00 135/123 |
| 8,745,782 | B2 | 6/2014 | Bemat | |
| 8,757,187 | B2 * | 6/2014 | Kiefer | F16C 11/0623 135/117 |
| D732,865 | S | 6/2015 | Roso | |
| 9,187,924 | B1 | 11/2015 | Jackson et al. | |
| 9,243,419 | B2 | 1/2016 | Niidome et al. | |
| 9,428,933 | B2 | 8/2016 | Simonson et al. | |
| 9,675,164 | B2 | 6/2017 | McDuffee | |
| 2016/0015181 | A1 | 1/2016 | Stitchick et al. | |
| 2017/0218654 | A1 | 8/2017 | Hanson | |

* cited by examiner

PORTABLE TENT PLATFORM

FIELD OF THE INVENTION

The present invention relates to the general field of platforms and is more specifically concerned with a portable tent platform.

BACKGROUND

A tent set on irregular, rough or humid ground can be uncomfortable for its occupants. There are ways of improving comfort, such as, for example, supporting the tent above the ground. However, existing structures used to that effect require a frame and other relatively bulky and heavy components, which may be inconvenient to carry to a campsite.

Against this background, there exists a need in the industry to provide an improved tent platform. An object of the present invention is therefore to provide such an improved tent platform.

SUMMARY OF THE INVENTION

In a broad aspect, there is provided a portable tent platform supported on a ground area, the portable tent platform including: a flexible support sheet defining a sheet peripheral edge; at least three legs, each leg defining a leg top end portion and an opposed leg bottom end portion, the leg bottom end portion being supported on the ground area, the flexible support sheet and each leg top end portion being secured to each other at a respective sheet mounting location of the flexible support sheet, the sheet mounting locations being located at vertices of a polygon defining a centroid; and at least three anchors anchored into the ground area and each extending from a respective one of the leg top end portions generally away from the centroid; the flexible support sheet being maintained under tension through the anchors pulling on the leg top end portions, which in turn pull on the flexible support sheet, and the flexible support sheet being maintained elevated above the ground area by the legs, the legs being all movable relative to the ground area independently from each other once the anchors have been removed the ground.

There may also be provided a portable tent platform wherein the leg top end portions and the flexible support sheet are secured to each other at the sheet peripheral edge.

There may also be provided a portable tent platform wherein the flexible support sheet defines mounting apertures extending therethrough at the mounting locations and delimited each by an aperture peripheral edge, the leg top end portions each defining a hook, the hooks being inserted in a respective one of the mounting apertures with the aperture peripheral edge engaging the hook.

There may also be provided a portable tent platform wherein the flexible support sheet defines mounting loops at the mounting locations, and the leg top end portions each define a respective mounting groove facing generally away from the centroid, the leg top end portions being each inserted in a respective one of the mounting loops with the mounting loop engaging the mounting groove.

There may also be provided a portable tent platform wherein the legs are substantially elongated, the anchors being angled relative to the legs.

There may also be provided a portable tent platform wherein the legs are generally oriented towards the centroid and acutely angled relative to the ground area.

There may also be provided a portable tent platform wherein the legs and the anchors are substantially perpendicular to each other.

There may also be provided a portable tent platform wherein the leg top end portions define each an anchor receiving aperture extending therethrough, the anchors including an anchoring portion inserted in the ground area, a head and an anchor mounting portion extending therebetween, the anchor mounting portion being received in the anchor receiving aperture and the anchoring portion and head protruding from the anchor receiving aperture on opposite sides thereof, the head being transversally larger than the anchor receiving aperture.

There may also be provided a portable tent platform wherein the anchoring portion includes a corkscrewed portion screwed into the grounds area.

There may also be provided a portable tent platform wherein the anchor mounting portion is substantially snugly and rotatably received in the anchor receiving aperture.

There may also be provided a portable tent platform wherein the leg top end portions define a recess adjacent the anchor receiving aperture and receiving the head thereinto.

There may also be provided a portable tent platform wherein a total length of the anchors between the head and a free end of the anchoring portion is between about 150% and 300% of a leg length of the legs.

There may also be provided a portable tent platform wherein the anchors are reversibly separable into two parts in the anchor mounting portion.

There may also be provided a portable tent platform wherein the leg top portion also defines a slot leading laterally into the anchor receiving aperture, the anchor mounting portion being removable from the anchor receiving aperture through lateral movement through the slot.

There may also be provided a portable tent platform wherein the leg top end portion defines a leg top surface and the leg bottom portion defines a leg bottom surface, the leg bottom and top surfaces being angled relative to the leg and substantially parallel to each other.

There may also be provided a portable tent platform including at least three additional anchors each engaging a respective one of the legs, extending generally away from the centroid and being anchored into the ground area so that each leg is anchored into the ground area through at least two anchors diverging from each other in a direction leading away from the leg.

There may also be provided a portable tent platform wherein the legs define a pointed member extending from the leg bottom portion for engaging the ground surface.

In another broad aspect, there is provided a kit for assembling a portable tent platform to be supported on a ground area, the kit including: a flexible support sheet defining a sheet peripheral edge; at least three legs, each leg defining a leg top end portion and an opposed leg bottom end portion, the leg bottom end portion being configured to be supported on the ground area, the flexible support sheet and each of the leg top end portions being mountable to each other at a respective sheet mounting location, the sheet mounting locations being located at vertices of a polygon defining a centroid; and at least three anchors each configured for engaging a respective one of the legs; wherein, when the kit is assembled in an operational configuration with the legs mounted to the flexible support sheet, the legs are between the flexible support sheet and the ground and the anchors extend generally away from the centroid and are anchored into the ground area so that the flexible support sheet is maintained under tension through the anchors pulling on the legs, which in turn pull on the flexible support sheet, and the flexible support sheet is maintained elevated above the ground area by the legs, the legs being all movable relative to the ground area independently from each other before the anchors are anchored into the ground surface.

There may also be provided a kit wherein the leg top end portions and the sheet are secured to each other at the sheet peripheral edge.

There may also be provided a kit wherein the flexible support sheet defines mounting apertures extending therethrough at the mounting locations and delimited each by an aperture peripheral edge, the leg top end portions each defining a respective hook, the hooks being insertable in a respective one of the mounting apertures with the aperture peripheral edge engaging the hook to mount the leg top portions and the flexible support sheet to each other.

There may also be provided a kit wherein the flexible support sheet defines mounting loops at the mounting locations, and the leg top end portions each define a respective mounting groove facing generally away from the centroid, the leg top end portions being each insertable in a respective one of the mounting loops with the mounting loop engaging the mounting groove to mount the leg top portions and the flexible support sheet to each other.

There may also be provided a kit wherein the legs are substantially elongated and define a leg longitudinal axis, the leg top end portions defining each an anchor receiving aperture extending therethrough angled relative to the leg longitudinal axis, the anchors including an anchoring portion insertable in the ground area, a head and an anchor mounting portion extending therebetween, the anchor mounting portion being received in the anchor receiving aperture and the anchoring portion and head protruding from the anchor receiving aperture on opposite sides thereof, the head being transversally larger than the anchor receiving aperture.

There may also be provided a kit wherein the anchor mounting portion is substantially snugly and rotatably received in the anchor receiving aperture.

There may also be provided a kit wherein the leg top end portions define a recess adjacent the anchor receiving aperture configured and sized for receiving the head thereinto.

There may also be provided a kit wherein a total length of the anchors between the head and a free end of the anchoring portion is between about 150% and 300% of a leg length of the legs.

There may also be provided a kit wherein the anchors are reversibly separable into two parts in the anchor mounting portion.

There may also be provided a kit wherein the leg top end portion defines a leg top surface and the leg bottom portion defines a leg bottom surface, the leg bottom and top surfaces being angles relative to the leg and substantially parallel to each other.

There may also be provided a kit wherein the leg top portion also defines a slot leading laterally into the anchor receiving aperture, the anchor mounting portion being removably insertable in the anchor receiving aperture through lateral movement through the slot.

There may also be provided a kit wherein the legs define a pointed member extending from the leg bottom portion for engaging the ground surface.

The tent platform is usable for supporting, for example, a self supporting camping tent in a spaced apart relationship relative to the ground area so as to avoid any discomfort due to a non uniform surface profile of the support ground surface and rain water accumulation.

Advantageously, in some embodiments, the proposed support platform is relatively light and compact when disassembled, while being relatively easy and quick to mount when needed. In some embodiments, the support platform is also usable to support a tent above rainwater accumulations on the ground.

The present application claims priority from UK Request for a Patent 1815639.8 filed Sep. 25, 2019, the contents of which is hereby incorporated by reference in its entirety.

Other objects, advantages and features of the present invention will become more apparent upon reading of the following non-restrictive description of some embodiments thereof, given by way of example only with reference to the accompanying drawings.

DETAILED DESCRIPTION

The terms "substantially" and "about" are used throughout this document to indicate variations in the thus qualified terms. These variations are variations that do not materially affect the manner in which the invention works and can be due, for example, to uncertainty in manufacturing processes or to small deviations from a nominal value or ideal shape that do not cause significant changes to the invention. Also, directional terminology, such as top and bottom, is used to denote orientation relative to a ground area on which the proposed support platform stands in the case of a horizontal ground area and this terminology should not be used to unduly limit the scope of the appended claim, for example in embodiments in which the proposed platform would be erected on a sloped or irregular ground area.

Figure 1:
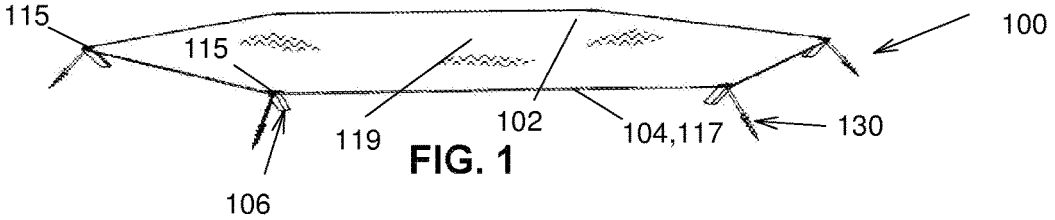
FIG. 1, in a perspective view, illustrates an embodiment of a portable tent platform, according to the present invention, here shown in a deployed state as if mounted on a ground area.
Figure 2:
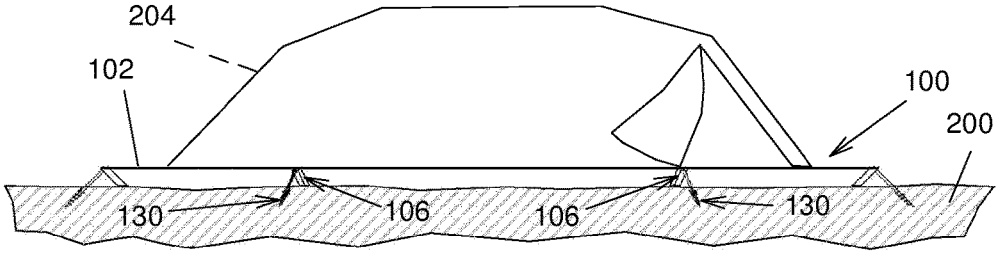
FIG. 2, in a side elevational view, illustrates the portable tent platform of FIG. 1, here shown mounted on a ground area and supporting a tent, shown in dashed lines.

FIGS. 1 and 2 illustrate a portable tent platform 100 according to an embodiment of the invention. The tent platform 100 comprises a flexible support sheet 102 having a predetermined surface dimension when in a fully extended state, and defining a sheet peripheral edge 104. Typically, the flexible support sheet 102 is substantially non-stretchable, for example stretching only a few percent or less when under tension in typical use, although more stretchable flexible support sheets 102 may be used in some embodiments. In some embodiments, the flexible support sheet 102 substantially maintains its strength and flexibility in a relatively wide temperature range, for example, between −20° C. and 40° C. The tent platform 100 further comprises at least three legs 106 and at least three anchors 130.

Figure 4:
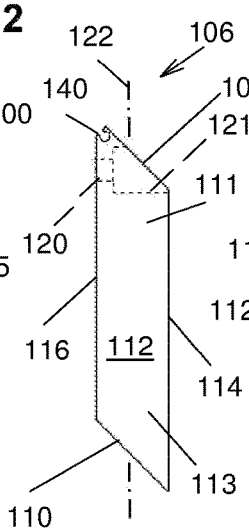
FIG. 4, in a side elevation view, illustrates a leg part of the portable tent platform of FIG. 1.
Figure 5:
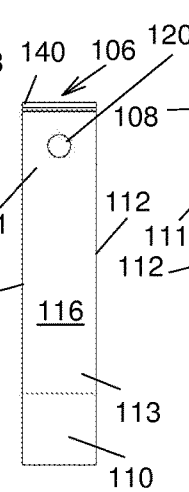
FIG. 5, in a front elevation view, illustrates the leg of FIG. 4.
Figure 6:
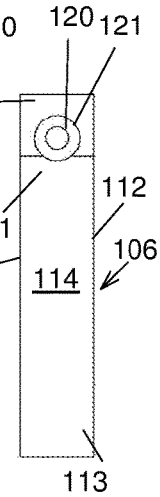
FIG. 6, in a rear elevation view, illustrates the leg of FIG. 4.

Referring for example collectively to FIGS. 4 to 6, each one of the at least three legs 106 includes a leg top end portion 111 and an opposed leg bottom end portion 113. In use, the leg bottom end portion 113 is supported on a ground area 200 (seen in FIG. 2 for example) on which the portable tent platform 100 stands. In a specific embodiments of the invention, the legs 106 are substantially elongated and, the leg top and bottom end portions 111 and 113 define respectively leg top and bottom surfaces 108 and 110. Typically, but not necessarily, the leg top and bottom surfaces 108 and 110 are angled relative to a longitudinal direction of the leg and substantially parallel to each other. Opposed lateral sides 112 and opposed inner and outer longitudinal sides 114 and 116 respectively each extend between the leg top and bottom surfaces 108 and 110.

Figure 7:
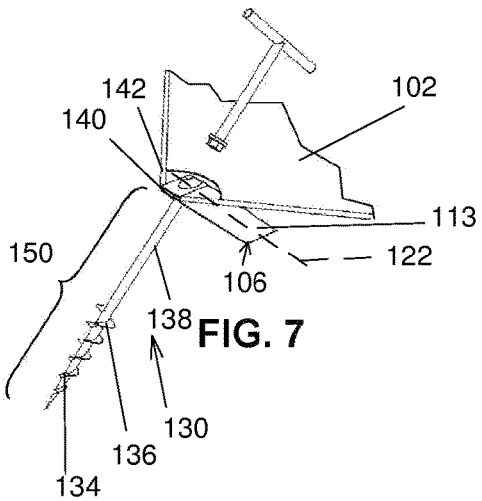
FIG. 7, in a perspective view, illustrates an anchor part of the support platform of FIG. 1 engaged in the leg of FIG. 4, which itself is mounted to a flexible support sheet, only partially shown.
Figure 8:
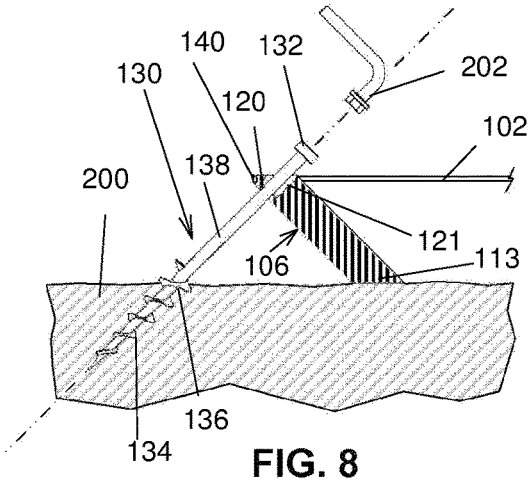
FIG. 8, in a side cross-sectional view respectively, illustrates the anchor, leg and partially shown flexible support sheet of FIG. 7.

Referring to FIGS. 7 and 8, each anchor 130 extends from a respective one of the leg top end portions 111. The anchors 130 are either permanently mounted to the leg top end portions or removably mounted thereto. For example, as seen in FIG. 8, each one of the at least three legs 106 defines an anchor receiving aperture 120 extending therethrough, typically having a cylindrical configuration and extending at a predetermined angle relative to a longitudinal axis 122 of the leg 106 in the leg top end portion 111, between the opposed inner and outer longitudinal sides 114 and 116, respectively, of the leg 106. In some embodiments, the legs 106 are substantially elongated and the anchors 130 are also substantially elongated and angled relative to the legs 106 when mounted thereto.

Furthermore, once the portable tent platform 100 is in an operational configuration, the flexible support sheet 102 and each leg top end portion 111 are secured to each other at a respective sheet mounting location 115 of the flexible support sheet 102, as seen for example in FIG. 1. The sheet mounting locations 115 are located at vertices of a polygon 117 defining a centroid 119. Typically, the leg top end portions 111 and the flexible support sheet 102 are secured to each other at the sheet peripheral edge 104. Each one of the at least three legs 106 is thus connected at suitable locations along the sheet peripheral edge 104 so as to allow the flexible support sheet 102 to be maintained in a substantially fully stretched state when each leg 106 is pulled substantially away from the centroid 119 in a same plane as the flexible support sheet 102, as exemplified in FIG. 3.

Referring more particularly to FIGS. 7 and 8, the tent platform 100 further comprises anchors 130, for example in corresponding number with the legs 106. Typically, the anchors 130 are to be anchored into the ground area 200 oriented generally away from the centroid 119. Typically, each one of the anchors 130 has a substantially elongated configuration defined by a head 132, an anchoring portion 134 adapted for removably and securely engaging the anchor 130 into the ground area 200, and an anchor mounting portion 138 extending therebetween. For example, the anchor mounting portion 138 has an elongate cylindrical configuration having a diameter suitably sized for freely rotatably engaging in a substantially snug fit relation the anchor receiving aperture 120 of the leg 106 with the anchoring portion 134 and head 132 protruding from the anchor receiving aperture 120 on opposite sides thereof. The head 132 is transversally larger than the anchor receiving aperture 120, for example by having at least a slightly greater diameter than the anchor receiving aperture 120 of the leg 106.

Furthermore, referring to FIGS. 7 and 8, with the anchor mounting portion 138 of the anchors 130 engaged in the anchor receiving aperture 120 of the leg 106, and the leg 106 having its leg bottom end portion 113 abuttingly resting on the ground area 200, the anchor mounting portion 138 and anchoring portion 134 of the anchor 130 have a combined longitudinal length 150 that is sufficiently dimensioned for allowing the anchoring portion 134 of the anchor 130 to be removably rigidly engaged into the ground area 200 using any compatibly configured tool 202 engaged with the head 132 and used to axially rotate the anchor 130.

With a first leg 106 and anchor 130 combination thus engaged into the ground area 200, a second leg 106 and anchor 130 combination, located for example substantially diametrically opposed the first combination relative to the flexible support sheet 102, may be pulled horizontally away from the first combination so as to effect an initial stretch action on the flexible support sheet 102, followed with the same procedure used for engaging the first combination into the ground area 200.

Figure 3:
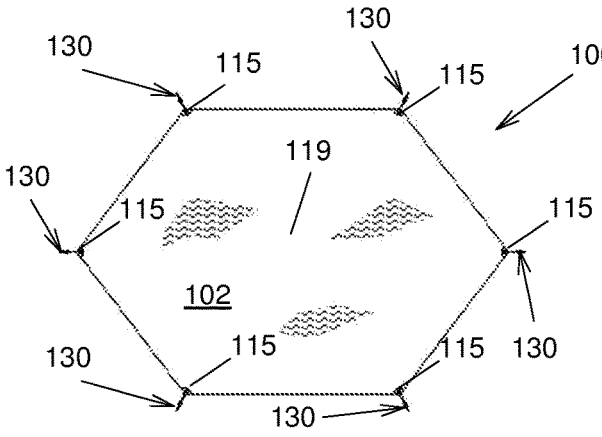
FIG. 3, in top plan view, illustrates the portable tent platform of FIG. 1.

Referring to FIGS. 1, 2 and 3, subsequently, other substantially diametrically opposed leg 106 and anchor 130 combinations around the flexible support sheet 102 may be firmly engaged into the ground area 200 so as to substantially uniformly stretch the flexible support sheet 102 to form the tent platform 100.

A non obvious aspect of the present invention resides in that, as the anchor 130 of a combination is progressively engaged into the ground area 200, the leg 106 provides support to the flexible support sheet 102 and simultaneously acts as a counter-lever member for stretching the flexible support sheet 102 as the anchor 130 is progressively engaged into the ground area 200. Thus, the flexible support sheet 102 is maintained under tension through the anchors 130 pulling on the leg top end portions 111, which in turn pull on the flexible support sheet 102, and the flexible support sheet 102 is maintained elevated above the ground area 200 by the legs 106. The proposed tent support platform is devoid of a frame at the periphery thereof that would link the legs 106 to each other so that the legs 106 are all movable relative to the ground area 200 independently from each other once the anchors 130 have been removed the ground.

As seen in FIG. 2, the portable tent platform 100 is usable for supporting, for example, a self supporting camping tent 204 in a spaced apart relationship relative to the ground area 200 so as to avoid any discomfort due to a non uniform surface profile of the ground area 200.

After use, each anchor 130 may be individually disengaged from the ground area 200 using a suitable tool 202, followed with folding the flexible support sheet 102 in a substantially compact format so as to conveniently stow the portable tent platform 100 in a backpack or the like for ease of transport thereof.

Typically, the flexible support sheet 102 includes a substantially lightweight, non-stretchable and resistant Nylon® fabric. Also, in some embodiments of the invention, the flexible support sheet 102 may be made of a suitable water permeable fabric mesh, thus preventing any rain water accumulation of the stretched support surface. Alternatively, the flexible support sheet 102 may be water impermeable, thus acting as a moisture barrier under the tent 204.

As would be known to someone familiar with camping equipment, the flexible support sheet 102 may further include padded surfaces, inflatable mattresses and the likes, either integrated in the flexible support sheet 102 or as add-on options through removable attachments such as Velcro®, snap buttons, zippers and the likes positioned along the top and/or bottom surfaces of the flexible support sheet 102.

The flexible support sheet 102 may have any suitable contour shape configuration such as, but not limited to, an elongated hexagonal configuration (as illustrated in FIGS. 1 and 3), or a circular, oval, square, rectangular or any other suitable polygonal contour configuration. Typically, the predetermined surface dimension of the flexible support sheet 102 is at least sufficiently sized for supporting the tent 204 for which it is configured.

The legs 106 are typically made of one of a substantially rigid and lightweight material such as, for example, aluminum, a rust proof steel, a suitable alloy thereof, a suitable polymeric material such as an ABS or PVC plastic, or a combination thereof. As best illustrated in FIGS. 4 and 7, in some embodiments, each leg 106 is removably mounted to the flexible support sheet 102, although legs 106 that are permanently mounted to the flexible support sheet 102 are also within the scope of the invention.

As exemplified in the figures, the leg 106 may define a mounting groove 140 extending transversally in the outer longitudinal side 116 at the leg top end portion 111, for example adjacent the leg top surface 108. The mounting groove 140 is suitably sized for removably engaging therein a mounting loop 142 attached to, or otherwise embedded along a portion of the sheet peripheral edge 104 of the flexible support sheet 102 and provided at the mounting locations 115. Typically, once the portable tent platform 100 has been set, the mounting groove 140 faces generally away from the centroid 119 and the leg top end portions 111 are each inserted in a respective one of the mounting loops 142 with the mounting loop 142 engaging the mounting groove 140. The legs 106 are generally oriented towards the centroid 119 and acutely angled relative to the ground area 200. In some embodiments each leg 106 is configured so that once the portable tent platform 100 has been set, the leg top and bottom surfaces 108 and 110 are respectively substantially in register with the stretched surface of the flexible support sheet 102, and the ground area 200.

In some embodiments, the leg top end portions 111 define a recess 121 adjacent the anchor receiving aperture 120 and receiving the head 132. Typically, the recess is of a diameter sufficient for also receiving the portion of the tool 202 that engages the head 132 if this diameter is larger than a diameter of the head 132.

The anchors 130 are for example made of a relatively lightweight yet rigid material such as, for example, aluminum, a rust proof steel, a suitable alloy thereof, or a combination thereof. If used in relatively soft ground surface, such as sand, anchors 130 may be made of a substantially rigid polymeric material such as ABS or PVC plastic.

Referring to FIG. 7, In some embodiments, a total length of the anchors 130 between the head 132 and a free end of the anchoring portion 134 is between about 150% and 300% of a leg length of the legs 106, but shorter or longer legs are within the scope of the invention. For example the total length is about twice the leg length.

The predetermined angle between the leg 106 and the anchor 130 is in some embodiments between 70 and 110 degrees, for example about 90 degree, although other angle values are also possible.

In some embodiments of the invention, the anchoring portion 134 of the anchor 130 includes a corkscrewed portion 136, either forming the shape of the anchoring portion 134, or, as shown in the drawings, defined by a thread extending from a central elongated rod shaped portion of the anchor 130, for screwing into the ground area 202. In some embodiments, and non-limitingly, the corkscrewed portion 136 is tapered in a direction leading away from the head 132. Other known earth penetrating configurations for the anchoring portion 134 are also possible.

The head 132 has for example a female or male hexagonal head configuration suitably sized and shaped for engaging a compatibly configured tool such as, for example, a relatively small and lightweight T-shaped hand tool 202 as illustrated in FIG. 7, or the Hex Allen key 202, as illustrated in FIG. 8. Other known configurations for the head 132 and its respective compatible tool are also possible.

Figure 9:
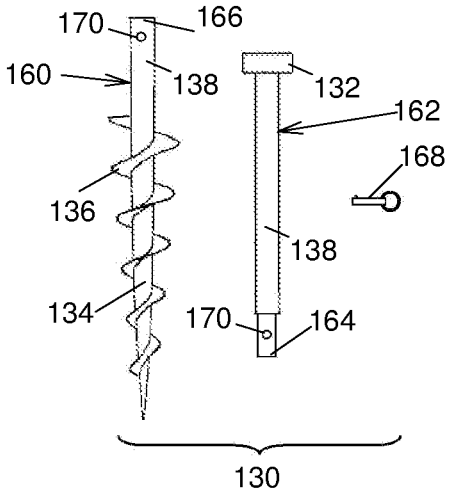
FIG. 9, in a side elevation exploded view, illustrates an alternate embodiment of an anchor usable in the portable support platform of FIG. 1.

Referring to FIG. 9, in some embodiments of the invention, the anchors 130 are reversibly separable into two parts in the anchor mounting portion 138. To that effect the anchor 130 may be a three piece component including a first longitudinal half 160, a second longitudinal half 162 having a lower end 164 removably engageable with an upper end 166 of the first longitudinal half 160, and a lock pin 168 removably engageable through corresponding lock holes 170 extending through the engaged upper and lower ends 166 and 164 respectively.

Thus, each anchor 130 may have the portion of the anchor mounting portion 138 of their second longitudinal half 162 slidably engaged first in the anchor receiving aperture 120 of a respective leg 106 before being assembled into a complete anchor 130, ready for engaging the ground area 200. In such embodiments, after use, each anchor 130 may be conveniently disassembled into a compact format for ease of transport, for example, in a backpack or the like.

Figure 10:
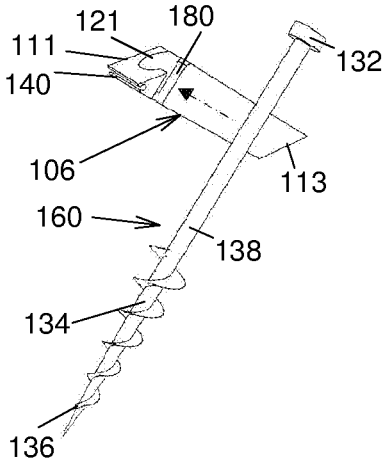
FIG. 10, in a perspective view, illustrates an alternate embodiment of a leg, here shown with an anchor in position for side insertion in a lateral slot of the leg.

Alternatively or in combination with the three piece anchors 130, referring to FIG. 10, in some embodiments of the invention, each leg 106 may further define a slot 180 leading laterally into the anchor receiving aperture 120. The anchor mounting portion 138 is removable from the anchor receiving aperture 120 and insertable thereinto through lateral movement through the slot 180.

Figure 11:
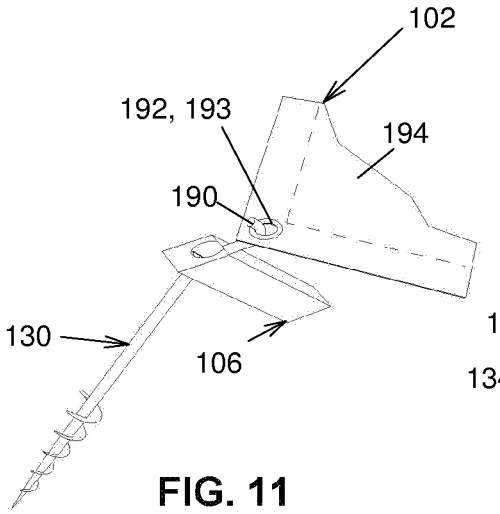
FIG. 11, in a partial perspective view, illustrates an alternate embodiment of a leg including a hook for engaging a metal eyelet part of an alternative flexible support sheet.

FIG. 11 illustrates an alternate embodiment of a leg 106 including a hook 190 in the leg top end portion 111, instead of a mounting groove 140 as in previous embodiments, for engaging a mounting aperture 192 extending through the flexible support sheet 102 at the mounting locations 115. The mounting aperture 192 is delimited each by an aperture peripheral edge 193, for example created by a metal eyelet of a tarpaulin 194, the latter then being used as the flexible support sheet 102. When the portable tent platform 100 is assembled, the hooks 190 are inserted in a respective one of the mounting apertures 192 with the aperture peripheral edge 193 engaging the hook 192.

Figure 12:
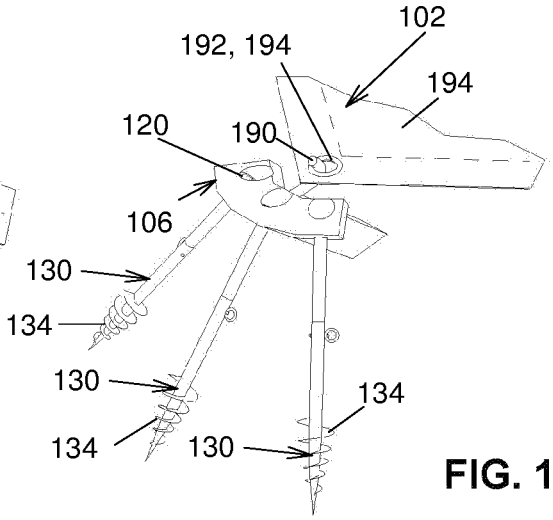
FIG. 12, in a partial perspective view, illustrates an alternate embodiment of a leg usable in the support platform of FIG. 1 and configured for mounting three anchors thereto.

FIG. 12 illustrates yet another alternate embodiment of a leg 106 including three anchor receiving apertures 120, instead of only one. Thus, for example, in cooperation with three anchors 130 having a relatively short anchoring portion 134, the portable tent platform 100 of the present invention may be engaged in a stony ground or in a relatively shallow earth layer over a rock bed. The relatively shorter anchors 130 distribute in the ground the pulling force of the stretched flexible support sheet 102. Other number of anchors 130 may be secured to each leg, such as 2 or 4, among others. Typically each anchor 130 mounted to a leg 106 extends generally away from the centroid 119 and are anchored into the ground area 200 so that each leg 106 is anchored into the ground area 200 through at least two anchors 130 diverging from each other in a direction leading away from the leg 106.

In some embodiments of the invention, the flexible support sheet 102 includes a skirt (not shown in the figures) extending radially distally along the sheet peripheral edge 104 thereof. The skirt is suitably configured and sized for at least substantially providing a shield surface between the stretched flexible support sheet 102 and the ground surface 200, so as to prevent cold gusts of winds from circulating under the portable tent platform 100.

Figure 13:
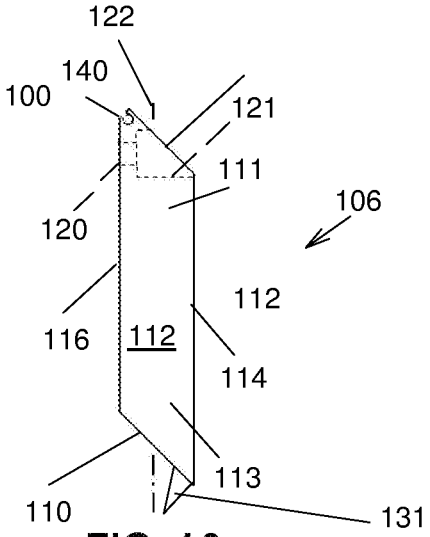
FIG. 13, in a side elevation view, illustrates yet an other alternate embodiment a leg part usable in the portable tent platform of FIG. 1.

In some embodiments of the invention, as seen in FIG. 13, the leg 106 further includes at least one relatively short pointed member 131 extending from the leg bottom end portion 113. The at least one pointed member 131 enhances the engagement of the leg 106 into the support ground surface and, hence, improves the counter-lever action of the leg 106 and anchor 130 combination as the anchor 130 is progressively engaged into the ground area 200. Thus, a relatively stronger stretching effect may be achieved on the flexible support sheet 102 by each leg 106 and anchor 130 combination.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. A portable tent platform supported on a ground area for supporting a camping tent usable by an intended user in a spaced apart relationship relative to the ground area, the portable tent platform comprising:

a flexible support sheet defining a sheet peripheral edge;

at least three legs, each leg defining a leg top end portion and an opposed leg bottom end portion, the leg bottom end portion being supported on the ground area, the flexible support sheet and each leg top end portion being secured to each other at a respective sheet mounting location of the flexible support sheet, the sheet mounting locations being located at vertices of a polygon defining a centroid; and at least three anchors anchored into the ground area and each extending from a respective one of the leg top end portions generally away from the centroid;

the flexible support sheet being maintained under tension through the anchors pulling on the leg top end portions, which in turn pull on the flexible support sheet, and the flexible support sheet being maintained elevated above the ground area by the legs, the legs being all movable relative to the ground area independently from each other once the anchors have been removed the ground;

wherein the flexible support sheet, at least three anchors and at least three legs are configured and sized to support a combined weight of the camping tent and of the intended user above the around surface on the flexible support sheet.

2. The portable tent platform as defined in claim 1, wherein the leg top end portions and the flexible support sheet are secured to each other at the sheet peripheral edge.

3. The portable tent platform as defined in claim 1, wherein the flexible support sheet defines mounting apertures extending therethrough at the mounting locations and delimited each by an aperture peripheral edge, the leg top end portions each defining a hook, the hooks being inserted in a respective one of the mounting apertures with the aperture peripheral edge engaging the hook.

4. The portable tent platform as defined in claim 1, wherein the flexible support sheet defines mounting loops at the mounting locations, and the leg top end portions each define a respective mounting groove facing generally away from the centroid, the leg top end portions being each inserted in a respective one of the mounting loops with the mounting loop engaging the mounting groove.

5. The portable tent platform as defined in claim 1, wherein the legs are substantially elongated, the anchors being angled relative to the legs.

6. The portable tent platform as defined in claim 5, wherein the legs are generally oriented towards the centroid and acutely angled relative to the ground area.

7. The portable tent platform as defined in claim 5, wherein the legs and the anchors are substantially perpendicular to each other.

8. The portable tent platform as defined in claim 7, wherein the leg top end portions define each an anchor receiving aperture extending therethrough, the anchors including an anchoring portion inserted in the ground area, a head and an anchor mounting portion extending therebetween, the anchor mounting portion being received in the anchor receiving aperture and the anchoring portion and head protruding from the anchor receiving aperture on opposite sides thereof, the head being transversally larger than the anchor receiving aperture.

9. The portable tent platform as defined in claim 8, wherein the anchoring portion includes a corkscrewed portion screwed into the grounds area.

10. The portable tent platform as defined in claim 8, wherein the anchor mounting portion is substantially snugly and rotatably received in the anchor receiving aperture.

11. The portable tent platform as defined in claim 8, wherein the leg top end portions define a recess adjacent the anchor receiving aperture and receiving the head thereinto.

12. The portable tent platform as defined in claim 8, wherein a total length of the anchors between the head and a free end of the anchoring portion is between about 150% and 300% of a leg length of the legs.

13. The portable tent platform as defined in claim 8, wherein the anchors are reversibly separable into two parts in the anchor mounting portion.

14. The portable tent platform as defined in claim 8, wherein the leg top portion also defines a slot leading laterally into the anchor receiving aperture, the anchor mounting portion being removable from the anchor receiving aperture through lateral movement through the slot.

15. The portable tent platform as defined in claim 5 wherein the leg top end portion defines a leg top surface and the leg bottom portion defines a leg bottom surface, the leg bottom and top surfaces being angled relative to a longitudinal axis of the leg and substantially parallel to each other.

16. The portable tent platform as defined in claim 1, further comprising at least three additional anchors each engaging a respective one of the legs, extending generally away from the centroid and being anchored into the ground area so that each leg is anchored into the ground area through at least two anchors diverging from each other in a direction leading away from the leg.

17. The portable tent platform as defined in claim 1, wherein the legs define a pointed member extending from the leg bottom portion for engaging the ground surface.

18. A kit for assembling a portable tent platform to be supported on a ground area for supporting a camping tent usable by an intended user in a spaced apart relationship relative to the ground area, the kit comprising:

a flexible support sheet defining a sheet peripheral edge;

at least three legs, each leg defining a leg top end portion and an opposed leg bottom end portion, the leg bottom end portion being configured to be supported on the ground area, the flexible support sheet and each of the leg top end portions being mountable to each other at a respective sheet mounting location, the sheet mounting locations being located at vertices of a polygon defining a centroid; and at least three anchors each configured for engaging a respective one of the legs;

wherein, when the kit is assembled in an operational configuration with the legs mounted to the flexible support sheet, the legs are between the flexible support sheet and the ground and the anchors extend generally away from the centroid and are anchored into the ground area so that the flexible support sheet is maintained under tension through the anchors pulling on the legs, which in turn pull on the flexible support sheet, and the flexible support sheet is maintained elevated above the ground area by the legs, the legs being all movable relative to the ground area independently from each other before the anchors are anchored into the ground surface;

wherein the flexible support sheet, at least three anchors and at least three legs are configured and sized to support a combined weight of the camping tent and of the intended user above the ground surface on the flexible support sheet when the kit is assembled in the operational configuration.

19. The kit as defined in claim 18, wherein the leg top end portions and the sheet are secured to each other at the sheet peripheral edge.

20. The kit defined in claim 19, wherein the flexible support sheet defines mounting apertures extending therethrough at the mounting locations and delimited each by an aperture peripheral edge, the leg top end portions each defining a respective hook, the hooks being insertable in a respective one of the mounting apertures with the aperture peripheral edge engaging the hook to mount the leg top portions and the flexible support sheet to each other.

21. The kit as defined in claim 19, wherein the flexible support sheet defines mounting loops at the mounting locations, and the leg top end portions each define a respective mounting groove facing generally away from the centroid, the leg top end portions being each insertable in a respective one of the mounting loops with the mounting loop engaging the mounting groove to mount the leg top portions and the flexible support sheet to each other.

22. The kit as defined in claim 18, wherein the legs are substantially elongated and define a leg longitudinal axis, the leg top end portions defining each an anchor receiving aperture extending therethrough angled relative to the leg longitudinal axis, the anchors including an anchoring portion insertable in the ground area, a head and an anchor mounting portion extending therebetween, the anchor mounting portion being received in the anchor receiving aperture and the anchoring portion and head protruding from the anchor receiving aperture on opposite sides thereof, the head being transversally larger than the anchor receiving aperture.

23. The kit as defined in claim 22, wherein the anchor mounting portion is substantially snugly and rotatably received in the anchor receiving aperture.

24. The kit as defined in claim 22, wherein the leg top end portions define a recess adjacent the anchor receiving aperture configured and sized for receiving the head thereinto.

25. The kit as defined in claim 22, wherein a total length of the anchors between the head and a free end of the anchoring portion is between about 150% and 300% of a leg length of the legs.

26. The kit as defined in claim 22, wherein the anchors are reversibly separable into two parts in the anchor mounting portion.

27. The kit as defined in claim 22 wherein the leg top end portion defines a leg top surface and the leg bottom portion defines a leg bottom surface, the leg bottom and top surfaces being angles relative to the leg and substantially parallel to each other.

28. The kit as defined in claim 22, wherein the leg top portion also defines a slot leading laterally into the anchor receiving aperture, the anchor mounting portion being removably insertable in the anchor receiving aperture through lateral movement through the slot.

29. The kit as defined in claim 18, wherein the legs define a pointed member extending from the leg bottom portion for engaging the ground surface.

30. In combination, a portable tent platform supported on a ground area and a tent supported by the portable tent platform, the portable tent platform comprising:

a flexible support sheet defining a sheet peripheral edge;

at least three legs, each leg defining a leg top end portion and an opposed leg bottom end portion, the leg bottom end portion being supported on the ground area, the flexible support sheet and each leg top end portion being secured to each other at a respective sheet mounting location of the flexible support sheet, the sheet mounting locations being located at vertices of a polygon defining a centroid; and at least three anchors anchored into the ground area and each extending from a respective one of the leg top end portions generally away from the centroid;

the flexible support sheet being maintained under tension through the anchors pulling on the leg top end portions, which in turn pull on the flexible support sheet, and the flexible support sheet being maintained elevated above the ground area by the legs, the legs being all movable relative to the ground area independently from each other once the anchors have been removed the ground;

wherein the camping tent is supported on the flexible support sheet above the ground surface.

* * * * *